US009850096B2

(12) United States Patent
Peacock et al.

(10) Patent No.: US 9,850,096 B2
(45) Date of Patent: Dec. 26, 2017

(54) TRAVELLING CABLE CLAMP ASSEMBLY, AN ELEVATOR ARRANGEMENT, AND A METHOD

(71) Applicants: Mark Peacock, Riihimaki (FI); Niki Backlund, Riihimaki (FI)

(72) Inventors: Mark Peacock, Riihimaki (FI); Niki Backlund, Riihimaki (FI)

(73) Assignee: Kone Corporation, Helsinki (FI)

( * ) Notice: Subject to any disclaimer, the term of this patent is extended or adjusted under 35 U.S.C. 154(b) by 721 days.

(21) Appl. No.: 14/264,768

(22) Filed: Apr. 29, 2014

(65) Prior Publication Data

US 2015/0307322 A1 Oct. 29, 2015

(51) Int. Cl.

| | |
|---|---|
| ***B66B 19/00*** | (2006.01) |
| ***B66B 7/08*** | (2006.01) |
| ***B66B 9/00*** | (2006.01) |
| ***B66B 7/06*** | (2006.01) |

(52) U.S. Cl.
CPC ..... *B66B 7/064* (2013.01); *B66B 19/00* (2013.01)

(58) Field of Classification Search
CPC ..... B66B 19/04; B66B 9/027; B66B 19/00; B66B 9/00; B66B 7/08; B66B 7/064; B66B 7/085; B66B 7/06
See application file for complete search history.

(56) References Cited

U.S. PATENT DOCUMENTS

| | | | | |
|---|---|---|---|---|
| 2008/0200077 | A1* | 8/2008 | Faulkner | B66B 7/064 439/783 |
| 2011/0113720 | A1* | 5/2011 | Peacock | B66B 19/00 52/741.1 |
| 2012/0291395 | A1* | 11/2012 | Plathin | B66B 19/02 52/741.1 |
| 2013/0233655 | A1* | 9/2013 | Peacock | B66B 19/00 187/414 |
| 2014/0305742 | A1* | 10/2014 | Graf | B66B 9/187 187/239 |

FOREIGN PATENT DOCUMENTS

| | | | | |
|---|---|---|---|---|
| FR | 2694279 | A1 * | 2/1994 | B66B 9/187 |
| JP | S5356672 | U | 5/1978 | |
| JP | S55156177 | A | 12/1980 | |
| JP | S581063 | A | 1/1983 | |
| JP | 2008207901 | A * | 9/2008 | |
| JP | EP 2460754 | A1 * | 6/2012 | B66B 7/064 |

OTHER PUBLICATIONS

Search Report for European Application No. 15160371.9 dated Sep. 1, 2015.

* cited by examiner

*Primary Examiner* — William E Dondero
*Assistant Examiner* — Diem Tran
(74) *Attorney, Agent, or Firm* — Harness, Dickey & Pierce, P.L.C.

(57) ABSTRACT

The present disclosure is related to a travelling cable clamp assembly fixing an elevator travelling cable to a fixing base, such as to a first movable support structure in the hoistway for supporting said at least one elevator unit movable in the hoistway, including at least an elevator car.

16 Claims, 3 Drawing Sheets

TRAVELLING CABLE CLAMP ASSEMBLY, AN ELEVATOR ARRANGEMENT, AND A METHOD

FIELD

The present disclosure relates to a travelling cable clamp assembly, an elevator arrangement, and a method in the manufacture of an elevator, which elevator is, for example, an elevator to be installed in a building and applicable to passenger transport and/or freight transport, and in which method and in which elevator arrangement the elevator is/can be taken into service use already during its construction-time an elevator, in particular to an elevator, which is suitable for transporting passengers and/or goods.

BACKGROUND

In so-called jump-lifts, the elevator hoistway is taken into use already before the full length of the elevator hoistway has been completed. The top part of the elevator hoistway is constructed at the same time as an elevator car moving in the already completed bottom part of the elevator hoistway serves people on the lower floors of the building. In jump-lifts, the elevator car moving in the bottom part of the elevator hoistway is supported and moved during the construction-time use suspended on hoisting ropes that are supported by a supporting platform in the elevator hoistway, which ropes are moved with a hoisting machine that is usually supported on the supporting platform. Installation work is done in the parts of the elevator hoistway above this supporting platform.

Generally in jump lifts the elevator car moving in the lower parts of the elevator hoistway is supported by a movable supporting platform positioned above the car in the hoistway. Often the car is moved during construction-time use with a hoisting machine supported on this supporting platform, but alternative locations for the hoisting machine also exist. The installation work in the parts of the elevator hoistway above this supporting platform is performed from a movable platform or corresponding in the elevator hoistway, which installation work comprises, among other things, the installation of guide rails and electrification in the elevator hoistway. When the elevator hoistway under construction above the supporting platform has reached a sufficient stage of completion, the completed part of the elevator hoistway can be taken into use. In this case a jump lift is performed, where the supporting platform is raised and mounted to a higher position in the elevator hoistway.

A travelling cable is fixed to the car of a passenger transport elevator and/or freight transport elevator, via which travelling cable the elevator car is in connection with the elevator control center. The travelling cable is typically a flat cable and comprises electrical conductors and a load-carrying bearer surrounded by a protective envelope. The travelling cable is used for power transmission and with it the necessary electrical energy is supplied to the elevator car and with it data is transmitted between the signaling devices of the elevator car, such as car call pushbuttons, communication devices and displays, and also the control system of the elevator. The load-bearing part of the travelling cable is frequently a steel rope bearer, typically a 6-strand or 8-strand steel rope, which comprises a steel core and strands passing around it. The travelling cable is typically fixed at the first end of the rope bearer to the elevator car and at the second end to the elevator hoistway by a travelling cable clamp.

Elevator safety codes require that travelling cables are supported by their integral steel ropes. In prior art, this is accomplished by stripping back the insulation and securing the ropes using proprietary clamps. A problem with known travelling cable clamp solutions with jump lifts has been that the travelling cable is ruined and unsafe to use. Especially in jump lifts, the travelling cable must be extended each time the supporting platform and the machine room are raised without cutting open the insulation.

BRIEF DESCRIPTION OF EXAMPLE EMBODIMENTS

At least some example embodiments solve previously described drawbacks of known solutions and problems discussed later. At least some example embodiments introduce a travelling cable assembly and a jump lift, which is improved in terms of clamping the travelling cable of a jump lift. It is an object, inter alia, to improve safety in using jump lift, particularly during jump time without stripping back the insulation of the travelling cable. At least some example embodiments are presented, inter alia, which facilitate allowing the travelling cable to be extended each time the supporting platform and the machine room are raised without cutting open the insulation and ruining the travelling cable.

During the process of extending the cable one or more, for example, two wedge clamps are used to manage the cable loop. Once the cable is in its new position the external "pinch" clamp is applied to the edges of the cable directly over the steel ropes inside the insulating jacket.

In order to comply with safety requirements a new type of travelling cable clamp has been designed which supports the cable from its integral steel ropes using a compression fitting which is applied on the outside of the cable insulation.

At least some example embodiments are directed to a new travelling cable clamp assembly fixing an elevator travelling cable to a fixing base, such as to a first movable support structure in the hoistway for supporting said at least one elevator unit movable in the hoistway, including at least an elevator car, said elevator being installed in a building and applicable to passenger transport and/or freight transport during the manufacture of an elevator. The travelling cable clamp assembly comprises a travelling cable, whose width is larger than its thickness in a cable transverse direction, comprising an insulating jacket with a first planar surface and a second planar surface, conductors for transmitting electrical energy and data between the elevator car and the fixing base, and one or more load-bearing elements of essentially the length of the travelling cable for fixing the travelling cable at its first end to the elevator car and at its second end to the fixing base, a first plate element being in touch with the first planar surface of the insulating jacket, a second plate element being in touch with the second planar surface of the insulating jacket, and space elements between the first and the second plate elements. The travelling cable clamp assembly comprises a gap through which said travelling cable passes and in which gap said travelling cable is arranged to be locked in its position between the first plate element and the second plate element by pressing said first and second plate elements to the edges of the travelling cable directly over the load-bearing elements inside the insulating jacket without cutting open the insulation jacket.

In at least some example embodiments, the assembly comprises an adjustable lock, such as bolts and nuts, by which means the travelling cable is arranged to be pinched in its position between the first plate element and the second plate element.

In at least some example embodiments, the travelling cable is continuously extendable in its length between the elevator car and the fixing base, such as the first movable support structure in the hoistway for supporting said at least one elevator unit movable in the hoistway including at least an elevator car.

In at least some example embodiments, the travelling cable is fed into the elevator by discharging the cable from a cable reel rotating in situ, on a reeling rack placed in the vicinity, such as on the top of the first movable support structure in the hoistway, for instance.

In at least some example embodiments, the first plate element and said second plate elements have inwards open hollow cavities for receiving said travelling cable, and the inwards open hollow cavities are fitted to pass against the insulating jacket with the first planar surface and the second planar surface of said travelling cable.

In at least some example embodiments, the space element is an elongated planar element with a rectangular cross section and the thickness of the space element between said first plate element and said second plate element is greater than the diameter of the load-bearing element of the travelling cable.

In at least some example embodiments, the travelling cable clamp assembly comprises a clamp fixing plate where said first plate element is fixed.

In at least some example embodiments, the travelling cable clamp assembly comprises a clamp fixing plate comprising one or more wedge clamps for managing the cable loop.

In at least some example embodiments, the first and second plate elements, the space elements, the wedge clamps, and the adjustable lock is made of metallic material, for example, steel or aluminum.

In at least some example embodiments, the first plate element, the second plate element, the space elements, and/or the wedge clamps are made of non-metallic material, such as glass or carbon fiber-reinforced polymer composite material. Hence the travelling cable clamp can be made more lightweight.

At least some example embodiments are directed to a new elevator arrangement, said elevator being installed in a building and applicable to passenger transport and/or freight transport during the manufacture of an elevator, comprising an elevator hoistway, at least one elevator unit movable in the hoistway, including at least an elevator car, a first movable support structure in the hoistway for supporting said at least one elevator unit movable in the hoistway, a travelling cable, whose width is larger than its thickness in a cable transverse direction, comprising an insulating jacket with a first planar surface and a second planar surface, conductors for transmitting electrical energy and data between the elevator car and the fixing base, such as the first movable support structure in the hoistway for supporting said at least one elevator unit movable in the hoistway, and one or more load-bearing elements of essentially the length of the travelling cable for fixing the travelling cable at its first end to the elevator car and at its second end to the fixing base, and a travelling cable clamp. The travelling cable is fixed to the fixing base, such as to the first movable support structure in the hoistway for supporting said at least one elevator unit movable in the hoistway by the travelling cable clamp assembly described above.

In at least some example embodiments, the first movable support structure in the hoistway for supporting said at least one elevator unit movable in the hoistway comprises an elevator control center and a hoisting machine.

At least some example embodiments are directed to a method of constructing an elevator, which elevator has been arranged to comprise during construction time an elevator hoistway, at least one elevator unit movable in the hoistway, including at least an elevator car, a first movable support structure in the hoistway above the elevator car, for supporting said at least one elevator unit, a travelling cable for transmitting electrical energy and data between the elevator car and the fixing base, such as the first movable support structure, and a travelling cable clamp assembly, in which method at least the following are performed:

a) the elevator car is used for transporting passengers and/or goods, and thereafter
b) the first movable support structure is lifted higher in the hoistway, and thereafter
c) the elevator car is used again for transporting passengers and/or goods.

In at least some example embodiments, the method further comprises an operation x wherein the travelling cable clamp fixing the travelling cable to the fixing base, such as to the first movable support structure is released and the travelling cable is extended in its length, the travelling cable being continuously extendable in its length between the elevator car and the fixing base, and wherein the travelling cable is fixed to its fixing base by the travelling cable clamp assembly as described above.

In at least some example embodiments, in operation x, a travelling cable is set to extend in the hoistway, for example, by dropping it into the hoistway, and by discharging the cable from a cable reel rotating in situ, on a reeling rack placed in the vicinity, such as on top of the first movable support structure in the hoistway.

In at least some example embodiments, operation x is performed plural times to stepwise make more room below the first movable support structure, and after performing operation x, where the second support structure is moved from an earlier mounting position above the roof structure upwards to a higher mounting position in the hoistway for a subsequent operation x, after which operation x is performed again.

The elevator as described anywhere above is, for example, but not necessarily, installed inside a building. The car is, for example, arranged to serve two or more landings. The car, for example, is arranged to respond to calls from landing(s) and/or destination commands from inside the car so as to serve persons on the landing(s) and/or inside the elevator car. For example, the car has an interior space suitable for receiving a passenger or passengers.

In at least some example embodiments, any cutting open of the insulation can be avoided so as to prevent any unsafe use of the travelling cable.

BRIEF DESCRIPTION OF THE DRAWINGS

In the following, at least some example embodiments will be described in more detail by way of example and with reference to the attached drawings, in which.

DETAILED DESCRIPTION

Figure 1:
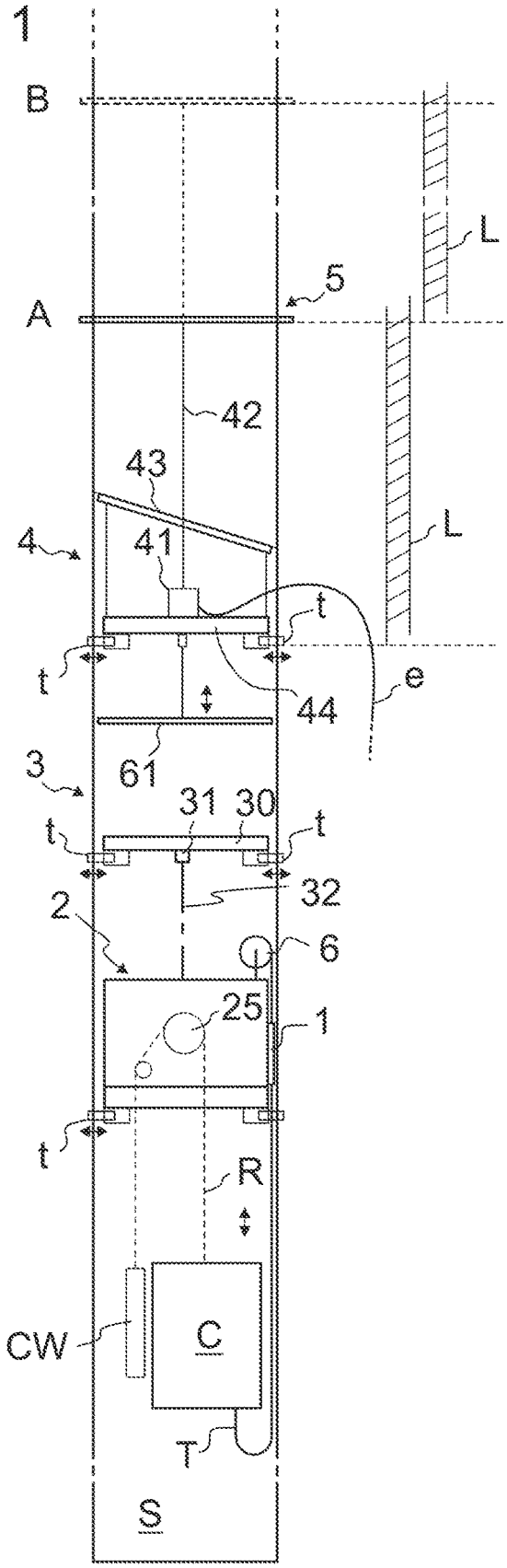
FIG. 1 illustrates schematically an elevator arrangement according to at least some example embodiments implementing a method according to at least some example embodiments.

In FIG. 1 it is illustrated, in at least some example embodiments, where the elevator arrangement has been arranged to comprise during construction time a hoistway S, and an elevator unit movable in the hoistway S, the elevator unit being an elevator car C for transporting passengers and/or goods. The elevator arrangement may also comprise additionally other movable elevator units such as the counterweight CW, as depicted. The elevator arrangement further comprises a first movable support structure 2 in the hoistway above the elevator car C, for supporting said at least one elevator unit C, CW, in this case with a roping R connected between elevator unit(s) and the support structure 2. The elevator arrangement further comprises a roof structure 4, separate from the movable support structure 2, in the hoistway S above the support structure 2, and a lifting arrangement 41, 42, 5 in the hoistway S for lifting the movable roof structure 4 higher in the hoistway S. The roof structure 4 is a movable roof structure, and the lifting arrangement 41, 42, 5 comprises a second movable support structure 5 mounted in the hoistway S above the movable roof structure 4, the lifting arrangement 41, 42, 5 being arranged to take support from the second movable support structure 5 for said lifting of the movable roof structure 4. Roof structure 4 can be lifted upwards separately from the movable support structure 2 so as to make room between them. In the method the elevator car C is used for transporting passengers and/or goods (a). The top part of the elevator hoistway S above the support structure 2 can be constructed at the same time as an elevator car C moving in the bottom part of the elevator hoistway S already serves people on the lower floors of the building. When the elevator hoistway under construction above the first movable support structure 2 has reached a sufficient stage of completion, the completed part of the elevator hoistway S can be taken into use. In this case elevator car is taken out of said use and a jump-lift is performed, wherein the first movable support structure 2 is lifted (b) and mounted to a higher position in the elevator hoistway. After this the elevator car C is taken back to said use for transporting passengers and/or goods (c). FIG. 1 also shows a third support structure 3 between the roof structure 4 and the supports structure 2 wherefrom support is taken for the lift of the first support structure 2 in b. The lifting of the first support structure 2 can be performed with a lifting device 31 pulling the first support structure 2 with a rope system 32 up. The lifting device may be in unity of the first or third support structure. However, the lifting of the support structure 2 need not be carried in this particular fashion as alternative arrangements exist. Before b the third support structure 3 can be lifted higher in the hoistway taking support from the roof structure 4. For this purpose the movable roof structure 4 may comprise a lifting device connected/connectable via a rope system to the third support structure 3. FIG. 1 also shows a movable working platform 61 below the movable roof structure 4, wherefrom elevator structures are installed by working on the working platform during said use of car C. The working platform is moved by taking support from the movable roof structure 4 mounted above the working platform 61. For enabling the lifting of the third movable support structure 3 the movable working platform 61 may be connected to the third movable support structure 3 for the time of the lifting. The lifting device 61 need not be positioned in unity of the movable roof structure, but instead it could be positioned in unity of the working platform 61.

When a suitable number of jump-lifts has been performed (cycles of operations a to c), for example the support structure 2 has become close to said roof structure 4, the movable roof structure 4 is lifted higher in the hoistway S so as to make more room below it. For this purpose the roof structure 4 is made to be a movable roof structure, having a support t transferrable to a state where they don't block vertical movement of the movable roof structure 4, such as laterally extendable support elements.

Figure 2:
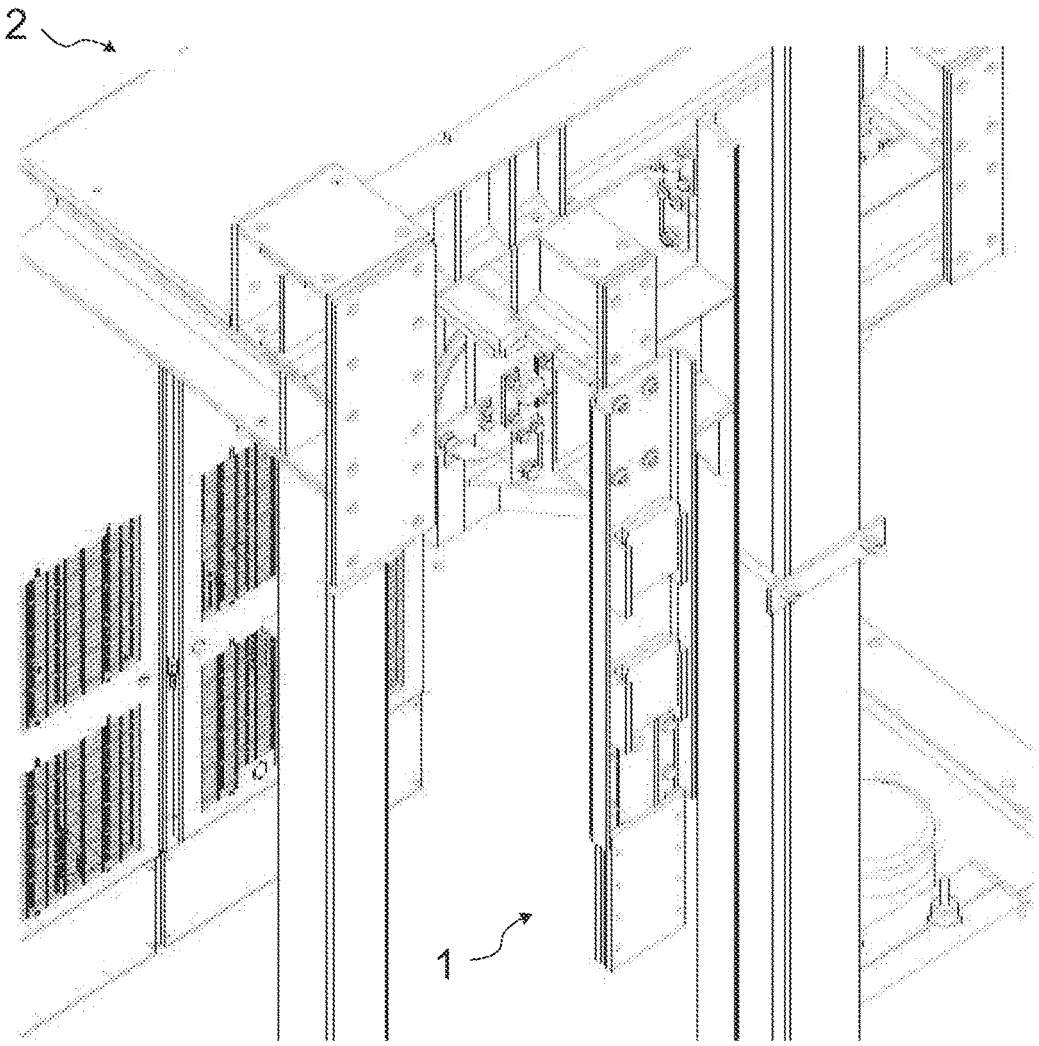
FIG. 2 illustrates a travelling cable clamp fixed in a fixing base according to at least some example embodiments.
Figure 4:
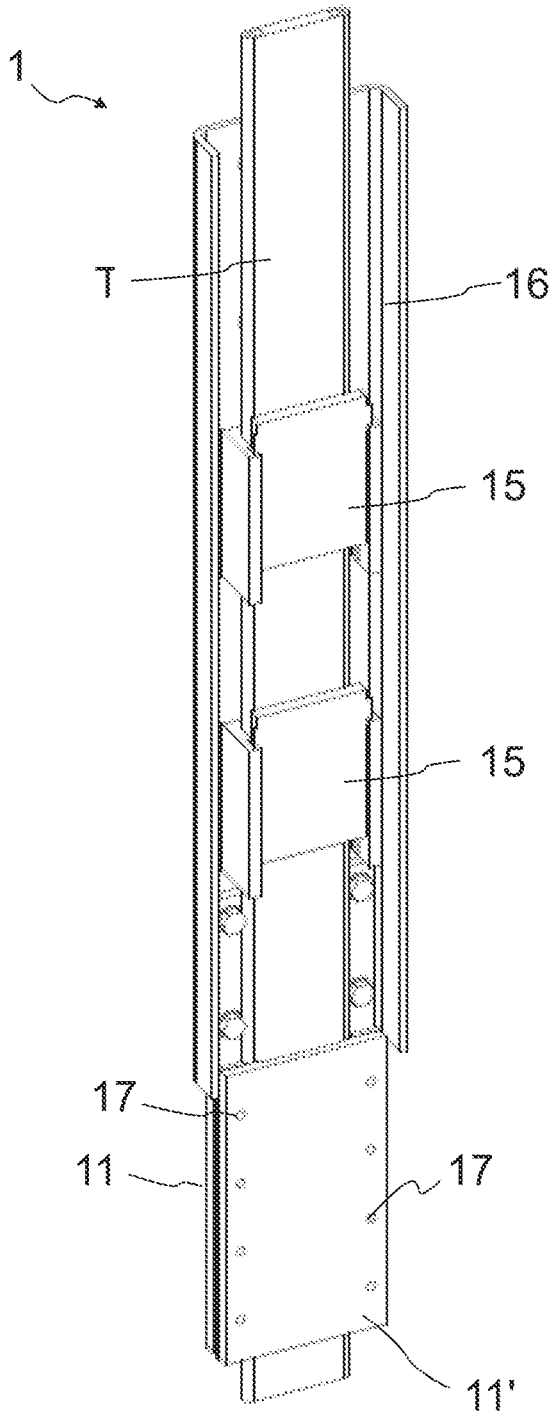
FIG. 4 illustrates a travelling cable clamp assembly according to at least some example embodiments for the elevator arrangement of FIG. 1.

FIG. 2 illustrates a travelling cable clamp 1 fixed to the first movable support structure 2 according to at least some example embodiments. FIG. 4 illustrates a travelling cable clamp assembly according to at least some example embodiments for the elevator arrangement of FIG. 1. In operation x the travelling cable clamp 1 fixing the travelling cable T to the fixing base, such as the first movable support structure 2 supporting the hoisting machine 25, is opened and the travelling cable T is extended in its length, the travelling cable T being continuously extendable in its length between the elevator car C and the fixing base. In operation x a travelling cable T is set to extend in the hoistway S, for example, by dropping it into the hoistway S, and by discharging the cable T from a cable reel 6 rotating in situ, on a reeling rack placed in the vicinity, such as on top of the first movable support structure 2 in the hoistway S. In operation x after the travelling cable T is extended to its length corresponding to the position of the first movable support structure 2 in the hoistway S the travelling cable T is fixed to its fixing base, such as the first movable support structure 2 by the travelling cable clamp 1.

Operation x is performed plural times to stepwise make more room below the first movable support structure, and after performing operation x, a operation is performed, where the second support structure 5 is moved from an earlier mounting position above the roof structure upwards to a higher mounting position in the hoistway for a subsequent x, after which the x is performed again.

The movable roof structure 4 is lifted in the hoistway S taking support for the lift from a second movable support structure 5 mounted in the hoistway S above the roof structure 4. As illustrated, support t has been transferred to unblocking state prior to the lifting of the movable roof structure 4. The operation is done when support structure 2 has been raised so close to roof structure 4 that more room is needed between them. Another reason for lifting the movable roof structure 4 could be that installation work of elevator components needs to be continued above the current level of the roof structure 4. The lifting of the movable roof structure 4 is arranged to be done without substantial dismantling of the roof structure 4, which is can be enabled by support t.

The movable roof structure 4 is lifted with a lifting arrangement 41, 42, 5 which is in the hoistway S. The lifting arrangement 41, 42, 5 comprises the second movable support structure 5, and, for example, also a rope 42, and a lifting device 41. Alternatively, other lifting structure could be used instead of rope 42 and device 41. For enabling a subsequent operation the second movable support structure 5 is mounted in the hoistway S in a mounting position A or B above the movable roof structure 4 as illustrated in FIG. 1. This mounting can be done at a suitable moment. In FIG.

1 mounting position A illustrates a mounting position where the second movable support structure 5 is to be mounted possibly for the first time. Mounting position B illustrates a mounting position where the second movable support structure 5 is to be mounted after the mounting position A, thus being higher than mounting position A. In both cases the lifting arrangement can be made to extend to the level of mounting position A or B for a subsequent operation by lifting the second movable support structure 5 to the level of its mounting position A or B from its earlier position. This can be done by performing operation e, for instance. The operation can be performed once, or alternatively plural times to stepwise make more room below the roof structure 4. In case of plural operations, after performing a preceding operation, the lifting arrangement is lifted to extend to the level of mounting position B for a subsequent operation. This is done, for example, by operation e where the second movable support structure 5 is moved from its earlier mounting position A upwards to a higher mounting position B in the hoistway S.

In operation e the lifting arrangement 41, 42, 5 is lifted to extend to the level of mounting position A or B for a subsequent operation. Said level of the mounting position A, B is above the level of the movable roof structure 4. This lifting is, for example, done at least partially manually by a person, for example, by carrying or by pulling up with a rope or equivalent. Thus, no complicated lifting system is needed to move the point of support higher in the hoistway S. The person can climb ladders or stairs L up to the level of the intended mounting position A or B of the second movable support structure 5. The person can carry the second movable support structure 5 up to this level (in one piece or in several) and mount it into position for lifting.

For example, after each operation the hoistway is sealed water-proof with the roof structure 4, e.g. by extending a water-proof membrane to extend up to the surface of the hoistway S. After the lifting of the movable roof structure 4, an operation cycle comprising operations a to c can be performed once or plural times as there is now more room between them. After said cycle/cycles, operations e and x can be performed again. By performing the sequence of operations (n times (a+b+c)+e+x) suitable number of times, the structures 2 and 4 can be lifted as high in the hoistway as needed.

As mentioned, the second support structure 5 is movable. This means that it is demountably supportable in different vertical positions in the hoistway S. It can be made to be in form of a beam resting, e.g. resting freely or in releasably fixed manner, on top of stationary supporting structures of the elevator, such as upper surfaces of structures of the hoistway and a sill of the landing door opening. The roof structure 4 is movable, as well. This means that it is demountably supportable in different vertical positions in the hoistway. For this purpose, the construction-time elevator has, for example, been arranged to comprise a support t for supporting the roof structure 4 stationary in the elevator hoistway S, which support t is transferrable between state I where the roof structure 4 is supported stationary and state II where the roof structure 4 is not supported stationary. When in state II, the support t does not block upwards directed vertical movement of the roof structure in the hoistway S. The first support structure 2 and/or the third support structure 3, for example, are made movable in corresponding manner as the movable roof structure 4.

Figure 3:
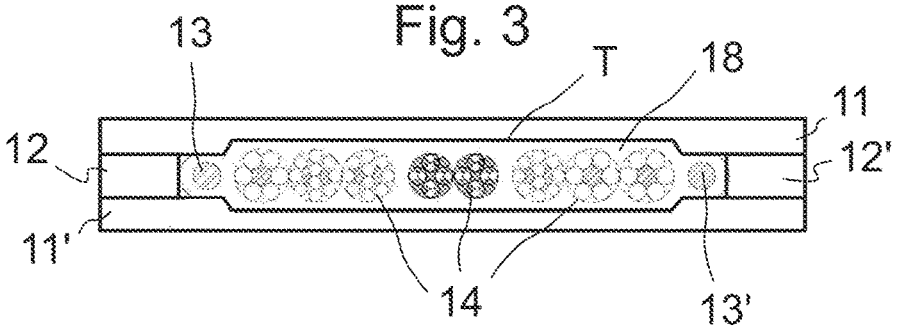
FIG. 3 illustrates schematically a cross section of the travelling cable clamp assembly according to at least some example embodiments.

FIG. 3 illustrates schematically a cross section of the travelling cable clamp assembly according to at least some example embodiments. The travelling cable clamp assembly comprises a travelling cable T, whose width is larger than its thickness in a cable transverse direction, comprising an insulating jacket 18 with a first planar surface and a second planar surface, conductors 14 for transmitting electrical energy and data between the elevator car and the fixing base, and one or more load-bearing elements 13, 13' of essentially the length of the travelling cable T for fixing the travelling cable at its first end to the elevator car C and at its second end to the fixing base 2, a first plate element 11 being in touch with the first planar surface of the insulating jacket 18, a second plate element 11' being in touch with the second planar surface of the insulating jacket 18, and space elements 12, 12' between the first and the second plate elements 11, 11'. The travelling cable clamp assembly comprises a gap through which said travelling cable passes and in which gap said travelling cable is arranged to be locked in its position between the first plate element 11 and the second plate element 11' by pressing said first and second plate elements 11, 11' to the edges of the travelling cable directly over the load-bearing elements 13, 13' inside the insulating jacket 18 without cutting open the insulation jacket 18.

The assembly comprises an adjustable lock 17, such as bolts and nuts, by which the travelling cable T is arranged to be pinched in its position between the first plate element 11 and the second plate element 11'.

The travelling cable T is continuously extendable in its length between the elevator car C and the fixing base, such as the first movable support structure 2 in the hoistway S for supporting said at least one elevator unit movable in the hoistway S including at least an elevator car C. The travelling cable T is fed into the elevator by discharging the cable T from a cable reel 6 shown in FIG. 1 rotating in situ, on a reeling rack placed on the top of the first movable support structure 2 in the hoistway S.

The first plate element 11 and said second plate element 11' have inwards open hollow cavities for receiving said travelling cable T, and the inwards open hollow cavities are fitted to pass against the insulating jacket 18 with the first planar surface and the second planar surface of said travelling cable T.

The space element 12, 12' is an elongated planar element with a rectangular cross section and the thickness of the space element 12, 12' between said first plate element 11 and said second plate element 11' is greater than the diameter of the load-bearing element 13, 13' of the travelling cable T. The travelling cable clamp assembly comprises a clamp fixing plate 16 where the first plate element 11 is fixed. The travelling cable clamp assembly also comprises a clamp fixing plate 16 comprising one or more wedge clamps 15 for managing the cable loop.

The first and second plate elements 11, 11', the space elements 12, 12', the wedge clamps 15, and the adjustable lock 17 is made of metallic material, for example, steel or aluminum. In at least one example embodiment, the first plate element 11, the second plate element 11', the space elements 12, 12', and/or the wedge clamps 15 are made of non-metallic material, such as plastics, glass or carbon fiber-reinforced polymer composite material.

The support t, for example, comprises laterally extendable support elements, as depicted in drawings, for instance. When in supporting state I, each support element may extend on top of a stationary supporting structure of the elevator, such as an upper surface of an elevator hoistway structure or a sill of the landing door opening. For this purpose, the hoistway S may be designed to have at intervals supporting structures. For instance, pockets can be made in the hoistway walls. The support elements can be formed to be laterally extendable and retractable back to non-extended state by linear movement or by pivoting. The support elements, for example, can be lockable into extended and/or contracted state. In FIG. 1, the support elements are movable between said positions by linear movement. The support t could have alternatively had a different design. An example alternative design would be such that the support t is a gripper arranged to grip elevator guide rails when in state I and not grip when in state II. Such a gripper would, for example, be in the form of a wedging-type gripper, having a wedging-part arranged to wedge between guide rail and an upwardly tapering housing surface of the gripper if the gripper moves downwards, thus utilizing a structure well known from elevator safety gear-devices.

As mentioned, the second movable support structure 5, for example, is portable by a person or includes plural portable by a person parts detachably connected. Thus, it can be carried or pulled by person in one piece or several to the level A or B which is the new mounting position thereof from a lower level. The second movable support structure 5, for example, is in the form of a beam. Thus it is simple and can be made rigid and reliable with low weight. A light but rigid beam structure 5 can be made from wood and/or metal. The weight of the second movable support structure is at most 35 kg, for example, at most 25 kg, for example, at most 20 kg in weight or the second support structure includes of plural detachably connected parts each having a weight of 35 kg at most for example, at most 25 kg for example, at most 20 kg.

The movable roof structure is, for example, such that a lifting device 41 for lifting the roof structure 4 is in unity of the movable roof structure 4. Furthermore, the roof structure 4 may also comprise a lifting device for lifting a working platform 61 below roof structure 4, for example, with roping. The movable roof structure 4, for example, also comprises a power supply f to the lifting device(s), the power supply being, for example, electrical power supply line and the lifting device 41 being an electrical lifting device. Thus the lifting device 41 can be accessed for used or maintenance easily. Also, power feed is in this way simple and, for example, provides power for multiple devices with only one line. The lifting device 41 is, for example, accessible via the platform and for example, fixed to the platform 44. The lifting device 41 is, for example, remotely controllable, e.g. via a control cable or a wireless connection.

Parts 32, 42 are, for example, ropes, such as metal ropes, but an equivalent flexible member could be used, such as a belt or chain. Correspondingly, roping R could be formed of ropes or equivalent components. With term portable structure it is meant structure that can be lifted manually by a person, particularly pulled up or carried by a person. In at least some example embodiments described, the end of the rope 42 is connected to the structure 5 such that hoisting ratio is 1:1. However, this is not necessary as alternatively the rope 42 could be connected to the structure 5 by a pulley(s) such that 2:1 hoisting ratio is achieved or more pulleys such that even higher ratio is achieved. It is to be understood that the above description and the accompanying figures are only intended to illustrate example embodiments. It will be obvious to a person skilled in the art that the inventive concepts can be implemented in various ways. The present disclosure and its example embodiments are not limited to the examples described above but may vary within the scope of the claims.

The invention claimed is:

1. A travelling cable clamp assembly configured to connect an elevator travelling cable to a first movable support structure in a hoistway, the first movable support structure configured to support at least one elevator car movable in the hoistway, the travelling cable clamp assembly comprising:

a travelling cable including an insulating jacket having a first planar surface and a second planar surface, conductors configured to transmit electrical energy and data to the elevator car, and one or more load-bearing elements configured to connect a first end of the travelling cable to the elevator car and a second end of the travelling cable to the first movable support structure;

a first plate element configured to contact the first planar surface of the insulating jacket;

a second plate element configured to contact the second planar surface of the insulating jacket; and at least two spacers between the first plate element and the second plate element with the travelling cable therebetween, the at least two spacers each being an elongated planar element having a length extending in a first direction of the one or more load-bearing elements and havirig a thickness in a second direction perpendicular to the first planar surface and the second planar surface that is greater than a diameter of the one or more load-bearing elements and less than a thickness in the second direction of the insulating jacket such that the first plate element and the second plate element are separated by a gap in the second direction through which the travelling cable is configured to lock between the first plate element and the second plate element, when the first plate element and the second plate element are pressed against the one or more load-bearing elements inside the insulating jacket without cutting open the insulation jacket.

2. The travelling cable clamp assembly according to claim 1, further comprising:

one or more adjustable locking devices configured to pinch the travelling cable between the first plate element and the second plate element.

3. The travelling cable clamp assembly according to claim 2, further comprising:

a clamp fixing plate configured to support the first plate element.

4. The travelling cable clamp assembly according to claim 3, further comprising:

one or more wedge clamps configured to manage cable loop formed by the travelling cable.

5. The travelling cable clamp assembly according to claim 4, wherein the clamp fixing plate, the first and second plate elements, the at least two spacers, the wedge clamps, and the one or more adjustable locking devices include a metallic material.

6. The travelling cable clamp assembly according to claim 4, wherein the clamp fixing plate, the first plate element, the second plate element, the at least two spacers, and/or the wedge clamps include a non-metallic material.

7. The travelling cable clamp assembly according to claim 1, wherein said travelling cable is continuously extendable in lengthwise direction between the elevator car and the first movable support structure.

8. The travelling cable clamp assembly according to claim 1, wherein said travelling cable is fed into the elevator by discharging the cable from a cable reel rotating in situ on a reeling rack connected to the first movable support structure.

9. The travelling cable clamp assembly according to claim 1, wherein the travelling cable is configured to fit within an open hollow cavity formed by the first plate element and the second plate element such that the insulating jacket is configured to contact the first planar surface and the second planar surface of the travelling cable.

10. An elevator arrangement comprising:

at least one elevator car movable in a hoistway;

a first movable support structure configured to support the at least one elevator car movable in the hoistway; and a travelling cable clamp assembly configured to connect an elevator travelling cable to the first movable support structure in the hoistway, the travelling cable clamp assembly including, a travelling cable including an insulating jacket having a first planar surface and a second planar surface, conductors configured to transmit electrical energy and data to the elevator car, and one or more load-bearing elements configured to connect a first end of the travelling cable to the elevator car and a second end of the travelling cable to the first movable support structure, and a travelling cable clamp including a first plate element, a second plate element, and at least two spacers between the first plate element and the second plate element, the first plate element configured to contact the first planar surface of the insulating jacket, the second plate element configured to contact the second planar surface of the insulating jacket, the at least two spacers each being an elongated planar element having a length extending in a first direction of the one or more load-bearing elements and having a thickness in a second direction perpendicular to the first planar surface and the second planar surface that is greater than a diameter of the one or more load-bearing elements and less than a thickness in the second direction of the insulating jacket such that the first plate element and the second plate element are separated by a gap in the second direction through which the travelling cable is configured to lock between the first plate element and the second plate element, when the first plate element and the second plate element are pressed against the one or more load-bearing elements inside the insulating jacket without cutting open the insulation jacket.

11. A method of constructing an elevator configured to perform a jump-lift during construction thereof, the elevator including an elevator car having a travelling cable connected thereto, the travelling cable including an insulating jacket having a first planar surface and a second planar surface, conductors configured to transmit electrical energy and data to the elevator car, and one or more load-bearing elements configured to connect a first end of the travelling cable to the elevator car and a second end of the travelling cable to the a first movable support structure, the method comprising:

using the elevator car to transport passengers and/or goods in a completed portion of a hoistway;

lifting the first movable support structure higher in the hoistway, the first movable support structure configured to support the elevator car;

releasing a travelling cable clamp to extend the traveling cable connected between the elevator car and the first movable support structure, the travelling cable clamp including a first plate element, and second plate element, and at least two spacers between the first plate element and the second plate element with the travelling cable therebetween, the first plate element configured to contact the first planar surface of the insulating jacket, the second plate element configured to contact the second planar surface of the insulating jacket, the at least two spacers each being an elongated planar element having a length extending in a first direction of the one or more load-bearing elements and having a thickness in a second direction perpendicular to the first planar surface and the second planar surface that is greater than a diameter of the one or more load-bearing elements and less than a thickness in the second direction of the insulating jacket such that the first plate element and the second plate element are separated by a gap in the second direction through which the travelling cable is configured to lock between the first plate element and the second plate element, when the first plate element and the second plate element are pressed against the one or more load-bearing elements inside the insulating jacket without cutting open the insulation jacket; and reenabling the elevator car again for transporting passengers and/or goods.

12. The method according to claim 11, further comprising:

extending the travelling cable in the hoistway by discharging the travelling cable from a cable reel rotating in situ on a reeling rack on top of the first movable support structure in the hoistway.

13. The method according to claim 11, further comprising:

performing a first iteratively jump-lift the elevator plural times by releasing the travelling cable clamp, and lifting the first movable support structure and the elevator car attached thereto as the completed portion of the hoistway increases; and moving a second support structure from an earlier mounting position above a roof structure upwards to a higher mounting position in the hoistway; and performing a second iteratively jump-lift of the elevator plural times by releasing the travelling cable clamp, and lifting the first movable support structure and the elevator car attached thereto as the completed portion of the hoistway increases.

14. A cable clamp, comprising:

a first plate element configured to contact a first planar surface of an insulating jacket of a cable;

a second plate element configured to contact a second planar surface of the insulating jacket; and at least two spacers between the first plate element and the second plate element with the cable therebetween, the at least two spacers each being an elongated planar element having a length extending in a first direction of one or more load-bearing elements of the cable and having a thickness in a second direction perpendicular to the first planar surface and the second planar surface that is greater than a diameter of the one or more load-bearing elements and less than a thickness in the second direction of the insulating jacket such that the at least two spacers are configured to maintain a gap in the second direction between the first plate element and the second plate element such that the cable is configured to extend within the gap and to lock between the first plate element and the second plate element, when the first plate element and the second plate element are pressed against one or more load-bearing elements inside the insulating jacket.

15. The cable clamp of claim 14, wherein the cable clamp is configured to lock the cable by pressing against the one or more load-bearing without cutting open the insulation jacket thereof.

16. The cable clamp of claim 14, further comprising:

one or more adjustable locking devices configured to pinch the cable between the first plate element and the second plate element.

* * * * *